United States Patent [19]

Wilson

[11] 4,072,309

[45] Feb. 7, 1978

[54] MULTI-PURPOSE EXERCISE DEVICE

[76] Inventor: Jerry Lee Wilson, 5816 Vista Clara, El Paso, Tex. 79912

[21] Appl. No.: 698,463

[22] Filed: June 21, 1976

[51] Int. Cl.[2] ..... A63B 21/04

[52] U.S. Cl. ..... 272/136; 272/142; 272/144; 272/123

[58] Field of Search ..... 272/144, 123, 135, 142, 272/136, 140, 117, 122, 145, 134

[56] References Cited

U.S. PATENT DOCUMENTS

| | | | |
|---|---|---|---|
| 3,501,143 | 3/1970 | Guerin | 272/142 |
| 3,638,941 | 2/1972 | Kulkens | 272/142 X |
| 3,647,209 | 3/1972 | La Lanne | 272/144 X |
| 3,662,602 | 5/1972 | Weiss | 272/142 X |
| 3,982,757 | 9/1976 | McDonnell | 272/136 X |
| 3,989,241 | 11/1976 | Ourgant | 272/142 X |

*Primary Examiner*—William H. Grieb
*Assistant Examiner*—William R. Browne
*Attorney, Agent, or Firm*—Seiler & Quirk

[57] ABSTRACT

A multiple purpose exercise device has a stable ground-supported frame having a single structural rail extending vertically at the rear thereof. A series of vertically aligned holes in a flange attached to the rail receive fastening pins for separately adjustably securing an exercise bench and a lever arm. The lever arm may be secured in a rigid position or in an upwardly or downwardly biased position by an interchangeable series of rigid connecting bars and spring members to allow the user to perform various pushing and pulling exercises.

8 Claims, 7 Drawing Figures

MULTI-PURPOSE EXERCISE DEVICE

BACKGROUND OF THE INVENTION

In recent years, increasing awareness and concern with the importance of physical health of our society has generated important, rapidly growing businesses concerned with physical fitness. Many people, particularly business executives having sedentary, tension-filled jobs, have been advised by their doctor to pursue a regular program of physical exercise. Gymnasiums, athletic clubs, and health studios are available to provide instruction and equipment for exercising; however, these facilities are often expensive and inconvenient. Busy executives are frequently unable to maintain a regular visitation schedule to an exercise club, and soon lose the routine of daily exercise. When the habit of regular exercise disappears, the executive usually finds that no exercises at all are being performed.

For many people, maintenance of a regular exercise schedule requires that the exercise be performed at home. A wide variety of home exercise devices have been developed. However, these devices generally do not have the capability of carrying out a large number of different exercises, as do the equipment at commercial gymnasiums, nor are they built to withstand heavy, frequent use. For example, Kulkens, U.S. Pat. No. 3,638,941 discloses a device for performing bench presses with an adjustably biased lever arm. Kane, U.S. Pat. No. 3,524,644, discloses a similar device which may be used for presses, pulls, or chin-ups. However, these devices are quite cumbersome and are better suited for use in an athletic club than in a home. In addition, neither allows a full complement of exercises.

A number of smaller exercise devices more suitable for home use are also known. Delinger, U.S. Pat. No. 3,545,748 discloses an adjustable exercise board allowing a variety of situp-type exercises. Lloyd, U.S. Pat. No. 3,664,666 discloses a portable gymnasium comprising a foldable, adjustable slantboard having spring-loaded pulley cables for performing various arm and leg exercises. A similar device is shown in Walker, U.S. Pat. No. 3,709,487. Kulkens, U.S. Pat. No. 3,902,717 also shows a multiple purpose apparatus providing for a plurality of spring-biased push-pull exercises. However, none of these devices allow the bench presses or pulls which most athletes consider essential to an exercise routine. In addition, although multi-functional and relatively portable, these devices are not built to withstand continual heavy usage of the type normally experienced in a commercial exercise facility.

Accordingly, it is an object of the invention to provide a versatile exercise apparatus which is heavy duty but is still easily storable and usable in the home.

It is a further object of the invention to provide apparatus which is simple and inexpensive to build, but which is quickly and easily adjustable to perform a wide variety of heavy exercises.

It is a further object of the invention to provide apparatus for various weightlifting exercises against a bias which is selectively either constant or increasing in resistance.

SUMMARY OF THE INVENTION

Multiple purpose exercise apparatus comprises a rigid frame having a ground supported base with a stationary vertical support rail. The rail has a plurality of vertically spaced means for releasably pivotally attaching a lever arm, and for attaching springs or stabilizers to the lever arm, allowing the lever to be selectively biased against upward or downward movement, or to be fixed in an immovable position. A removable bench is also provided having one end supported at a fixed distance above the ground and the other end adjustably attachable to the rail.

BRIEF DESCRIPTION OF THE DRAWINGS

The apparatus of the invention is best understood with reference to the drawings, of which.

DETAILED DESCRIPTION OF THE INVENTION

Figure 1:
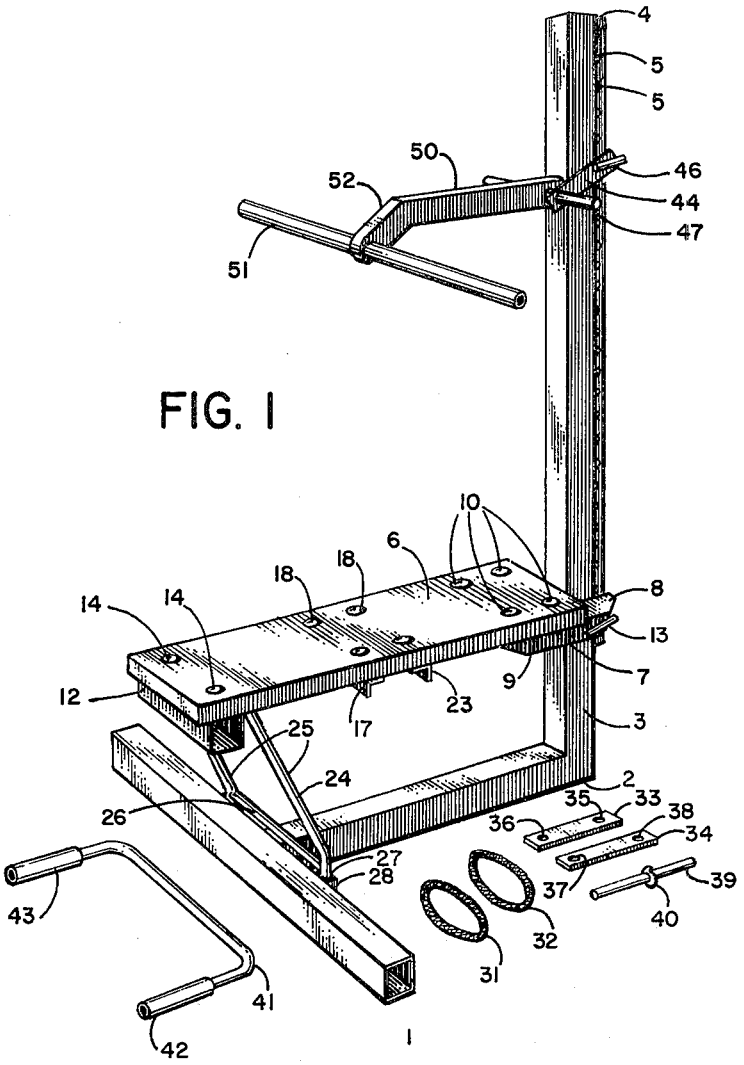
FIG. 1 is a perspective view of the apparatus and accessories showing the bench in horizontal position.
Figure 2:
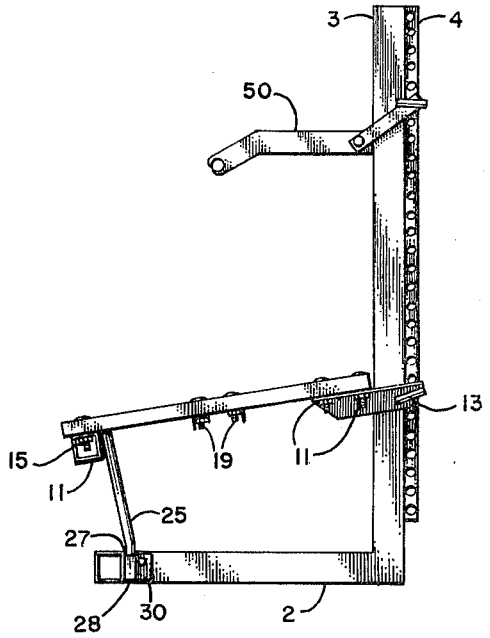
FIG. 2 is a side view of the apparatus showing the bench in elevated position.

Referring to FIG. 1, the apparatus comprises a rigid frame consisting of a stable ground supported base formed by T-shaped members 1 and 2, and a vertical rail 3 extending upwardly from the rear of the base. The frame is fabricated from 3 inches square hot rolled steel tube, and may be joined by welds, bolts, or any other metal fastening technique. In FIG. 2, base members 1 and 2 are bolted with a section of angle iron 30 and a corresponding section of angle iron (not shown) on the opposing side of the joint.

A flange 4 fabricated from $\frac{3}{8}$ inch $\times$ $1\frac{1}{2}$ inches bar steel is welded to the center of the back panel of rail 3. A series of vertically oriented bores are used to receive fastening pins 45, 39, and 13. These pins are variously used for removably attaching the bench 6, stabilizer bars 33 and 34, and springs 31 and 32 to the rail.

Bench 6 is shown in FIG. 1 in its normally horizontal position located parallel to and directly above base member 2. The bench is supported at its forward end by bench support 24 which consists of two transversely spaced parallel legs 25 and cross support member 26. Another parallel cross member (not shown) at the top of legs 25 connects the two legs and provides support for the front of the bench. The feet 27 of the support are loosely enclosed in braces 28 and 29, which are welded to the inside of base member 1. These braces maintain the feet in place and prevent movement of the bench support when the apparatus is in use. The bench support is made from $\frac{5}{8}$ inch steel rod; the braces are 1 inch square steel tubing sections.

The rear end of the bench is removably attached to rail 3. Two identical angle irons 7 having 3 inches flanges 8 and 9 are bolted to the bottom of the bench with bolts 10 and nuts 11 on either side of the rail. Both angle irons have the horizontal flange extending outwardly and vertical flange extending downwardly from the center line of the bench; only one angle iron fastener is shown in FIGS. 1 and 2, the other being blocked from view. The bench is secured to the rail by inserting pin 13 through bores in the vertical flanges of both angle irons and one of the bores 5 in the flange 4 of rail 3. As is seen in FIG. 2, the board may be slanted to any desired angle simply by selecting the appropriate hole in the rail for fixing the pin.

The bench may be completely removed by removing pin 13 and lifting the bench upward and away from support 24. Additional transverse supports are also attached to the bottom of the bench; a section of 3 inches square tubing 12 is bolted to the front of the bench by bolts 14 and nuts 15, and two opposing 3 inches angle iron members 17 and 23 are bolted to the center section of the bench with bolts 18 and nut 19. The vertical flanges on the angle irons are spaced slightly greater than 3 inches apart. For exercises in which the user is standing, the bench is removed from the rail, rotated 90°, and set across base member 2, with angle irons 17 and 23 straddling member 2. The angle irons are helpful to center the bench, but are not considered an essential feature of the invention. The bench is maintained horizontal by supports 12 and 9 on the ends. The user then stands on the bench and can perform standing lifts, such a shoulder presses and toe lifts, without lifting the apparatus off the ground.

Figure 3:
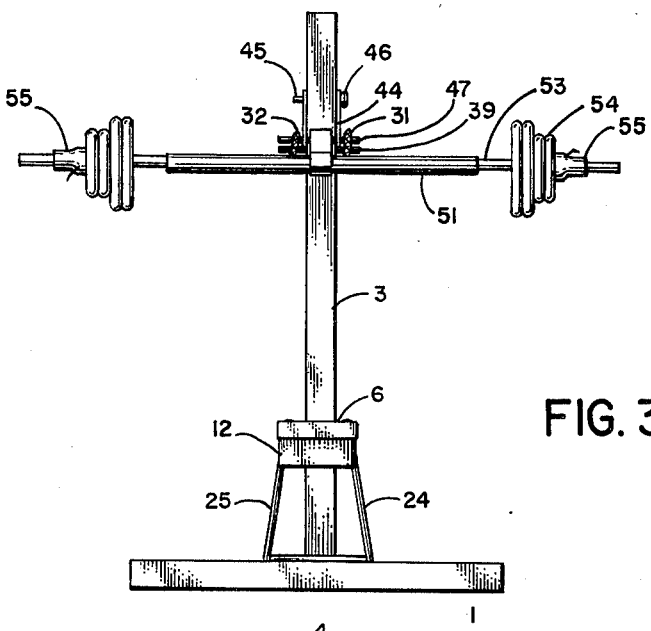
FIG. 3 is a front view showing barbells carried by the lever arm, and also showing springs in place biasing the lever arm against upward movement.

The simplicity and versatility of the apparatus of the invention is largely contributed by the design of the lever arm. Lever arm 50 extends forwardly from the center of rail 3, and is pivotally connected to the rail by pins 45 and 47 and rigid fingers 44 and 49. Pin 47 and fingers 44 and 49 are permanently welded to arm 50; no relative rotation of these members is possible. In other words, members 44 and 49 are simply a rigid, angular extension of arm 50. The arm is pivotally connected to the rail by pin 45 having handle 46. Finger 49 is shown in FIG. 3. FIG. 1 shows lever arm 50 in unbiased condition, with the rear portion of the arm resting against the rail. In this manner, the arm may be moved freely in an upward direction but cannot be moved down.

Figure 6:
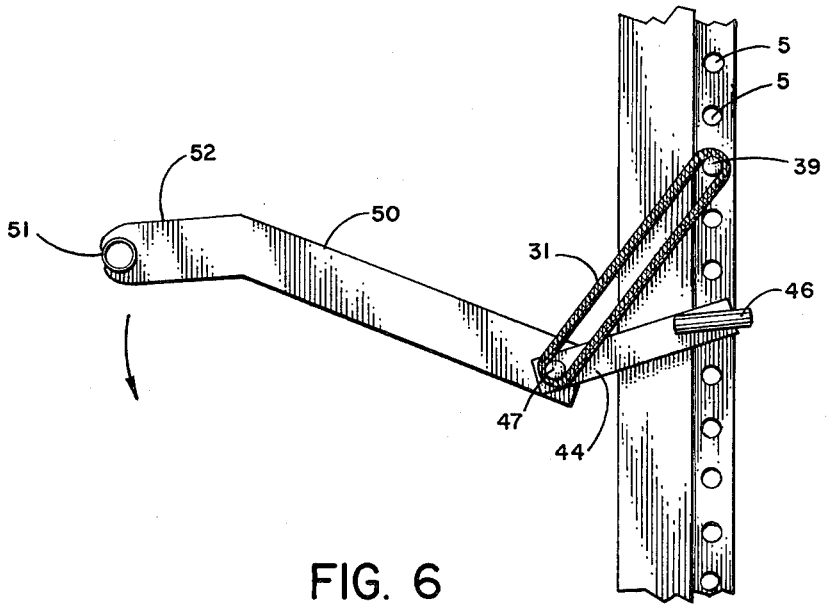
FIG. 6 is a partial side view with the lever arm biased for pulls.

FIG. 6 shows the arm in upwardly biased condition. The arm is pivotally connected to the rail through fingers 44 and 49 (not visible). Circular spring cords 31 and 32 provide tension biasing means; these cords are slipped around pin 47 of the lever arm and pin 39, which is inserted through a bore 5 in the rail above the location of attachment of members 44 and 49. The springs are aircraft shock cords, which are commercially available; suitable cords are No. 9044 aero shock cords, $\frac{5}{8}$ inch diameter, made by the Russell Manufacturing Division of Fenner America, Ltd. These cords are latex rubber covered with fabric for abrasion resistance. Each cord, at complete extension, is approximately the equivalent of a 50 pound weight, although it will be appreciated that the resistance supplied by each cord increases with the degree of extension in the manner of a coil spring. In FIG. 6, a user sitting or standing on bench 6 would pull or push downwardly on handle grips 51 of arm 50, with the resistance increasing with the extent of travel of the arm.

Figure 7:
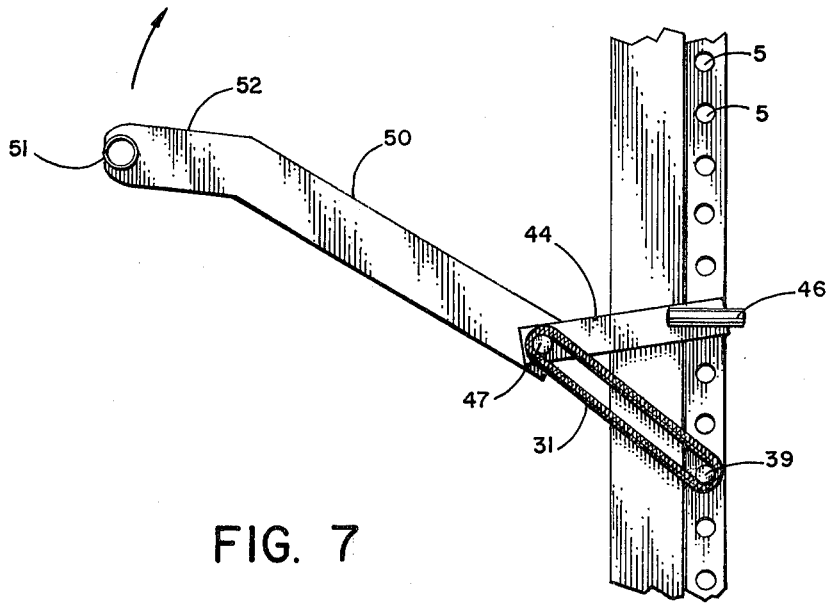
FIG. 7 is a partial side view showing the lever arm biased for presses.

FIG. 7 shows the arm in downwardly biased condition, with spring-holding pin 39 being located below pin 45 on the rail. The drawing shows the spring in slightly extended position; at rest, the rear end of arm 50 would abut the rail, with the spring being slack. In this condition, the user presses or pulls upwardly on the arm, obtaining resistance from the stretching cords on either side of the rail.

Figure 5:
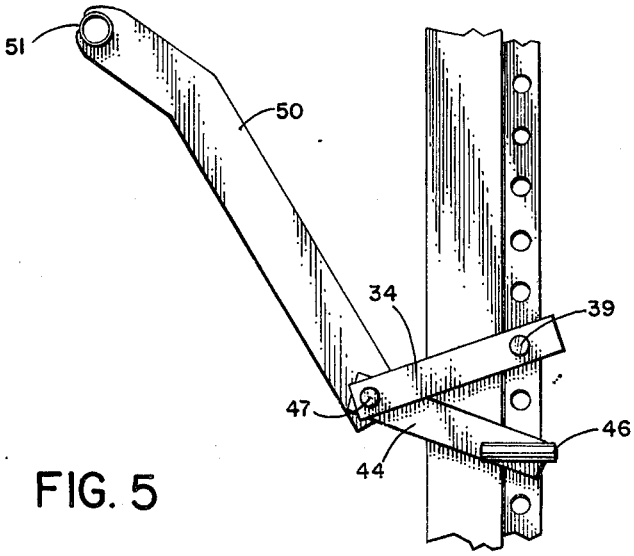
FIG. 5 is a partial side view of the rail with the lever arm stabilized in position for chin-ups.

FIG. 5 shows the lever arm in a fixed position, particularly useful for pull-ups or chin-ups. The lever arm is generally located at the upper end of the rail for these exercises, allowing the user to have his feet completely off the ground even when his body is extended. Instead of using springs to bias the arm, a set of stabilizer bars 33 and 34 are used to fix the position of the arm. Stabilizers 33 and 34 are slipped in place by sliding the apertures in each end thereof over pin 47 and removable pin 39, respectively.

The resistance against which a user must exert force is easily varied by adding one or more spring cords to either side of the rail. In addition, provision is made for carrying a standard set of weights, as shown in FIG. 3. Handle 51 is fabricated from 1 inch hollow steel pipe, and the carrier grip 53 for a conventional barbell may be inserted through the handle. Weights 54 can be secured on the ends thereof by a retainer 55. The weights, which are metal discs having a mounting hole in the center thereof, may be used in place of the spring cords, thereby providing constant (isotonic) resistance to force (as is commonly used for most weightlifting exercises), or may be used in combination with the cords. Alternate methods of attaching the weights to the handle would be to either have a tapered handle having a smaller diameter near the ends so that conventional weights would slip over the end, or to have an entire handle of smaller diameter, with grips for the user's hands being placed over the handle concentrically. The variable resistance cords provide a measure of safety for the user, since the maximum load would need to be carried only at full extension. Most weightlifting injuries are sustained at the beginning of each movement if the user has selected too much weight.

Figure 4:
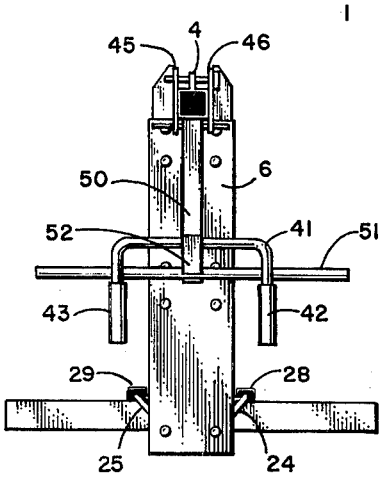
FIG. 4 is a top view with handlebars in place for body raises.

Yet another alternative arrangement of the apparatus is shown in FIG. 4. Handlebars 41 are inserted under lever arms 50, resting at the joint formed by the forward angled portion 52 of the arm, with the grips 42 and 43 resting above handle 51. The user may face toward or away from the apparatus, and lift his body by pressing downward on the grips. The apparatus is normally used without the bench in this manner.

The ease of converting the apparatus from one mode of exercise to another is an important feature of the invention. The lever arm can be upwardly or downwardly biased, or stabilized, simply by moving pins 39 and 45 and sliding on the appropriate springs or stabilizers. Similarly, the lever arm and bench can be moved up and down to adjust to different size users or different exercises, or removed completely in a matter of seconds. Accordingly, a full complement of exercises can be performed with a minimum amount of time and energy being expended for alteration of the apparatus.

A wide variety of exercises can be performed with the apparatus of the invention. These include bench presses, shoulder presses, squats, toe raises, high lat pulls, dips, pull-ups, chin-ups, horizontal and inclined sit ups, leg presses, donkey raises, and many other exercises and variations which are known to those skilled in the art. Normally, equipment which affords these types of exercises requires equipment which cannot practically be fit into a home. The apparatus of the invention is compact, and inexpensively manufactured without being limiting with regard to performance.

Many variations on the apparatus as described are possible within the scope of the invention. For example, the base may be any shape as long as it provides stability from tipping. Any type of fastening means may be used to fasten the bench and lever arm to the rail, as long as the lever arm can pivot in a vertical plane around the fastening point. Any type of spring means, such as a helical tension spring or dashpot, may be used in place of the airplane shock cords. Other means for adjustably attaching the lever arm to the rail may be used; for example, the rail may consist of two telescoping tube members which can be locked at various extensions, e.g. by a friction lock or pin lock. These and many other variations would be apparent to one skilled in the art and still be within the spirit and scope of the invention, which should be limited only by the following claims.

I claim:

1. Multiple purpose exercise apparatus comprising:

a frame having forward and rearward positions comprising a ground-supported base and a stationary vertical support member extending upwardly from the rear of the base, a bench, support means associated with said frame for maintaining the bench at a level above the base, a lever arm pivotally attached to said vertical support member and extending outwardly over said base, fastening means for securing the lever arm to the support member comprising a plurality of vertically aligned bores in the support member, a transverse bore carried by the rearward portion of the lever arm, and pin means extending through both bores for removably pivotally attaching the lever arm to the vertical support member such that the lever arm can move freely only in a vertical plane, biasing means attachable to the lever arm at a position spaced from the connection of the lever arm on the vertical support member for selectively providing resistance to upward or downward motion of the lever arm in the vertical plane, and attachment means mountable in the vertically aligned bores for selectively attaching the biasing means at various position on the vertical support member.

2. The apparatus of claim 1 wherein the bench has forward and rearward ends, and comprises connecting means at the rearward end thereof cooperating with the fastening means carried by the vertical support member for removably attaching the bench to the frame at various elevations.

3. The apparatus of claim 1 wherein the lever arm also comprises a handle transverse to the arm, the handle comprising grip means for grasping the handle, and mounting means for securing a plurality of conventional disc weights on each end of the handle.

4. The apparatus of claim 3 wherein the handle comprises a hollow tube.

5. The apparatus of claim 1 also comprising at least one rigid spacer bar having one end thereof attachable to the lever arm and the other end thereof attachable to the vertical support member at a location different from the location of attachment of the lever arm to the support member, thereby preventing vertical movement of the lever arm.

6. The apparatus of claim 1 wherein the vertical support member comprises a rail having a plurality of vertically aligned bores therein, the lever arm also comprises two fingers extending from the rearward portion thereof, each finger having a bore therein axially aligned with respect to the other, the apparatus also comprising a removable pin having circular cross-section for insertion consecutively through the bore in one finger, the bore in the rail, and the bore in the other finger, thereby pivotally connecting the lever arm to the rail.

7. The apparatus of claim 6 wherein the biasing means comprises a circular elastic cord.

8. The apparatus of claim 6 wherein the lever arm carries attachment means for the biasing means, and the apparatus also comprises removable attachment means for the biasing means selectively mountable in a bore in the rail at a location either above or below the connection of the lever arm to the rail.

* * * * *

REEXAMINATION CERTIFICATE (171st)

United States Patent [19]

Wilson

[11] B1 4,072,309

[45] Certificate Issued Mar. 6, 1984

[54] MULTI-PURPOSE EXERCISE DEVICE

[76] Inventor: Jerry L. Wilson, 5816 Vista Clara, El Paso, Tex. 79912

Reexamination Request:
No. 90/000,357, Mar. 28, 1983

Reexamination Certificate for:

| | |
|---|---|
| Patent No.: | **4,072,309** |
| Issued: | **Feb. 7, 1978** |
| Appl. No.: | **698,463** |
| Filed: | **Jun. 21, 1976** |

[51] Int. Cl.[3] ..... A63B 21/04

[52] U.S. Cl. ..... 272/136; 272/142; 272/144; 272/123

[58] Field of Search ..... 272/144, 123, 135, 142, 272/136, 140, 117, 122, 145, 134

[56] References Cited

U.S. PATENT DOCUMENTS

| | | | |
|---|---|---|---|
| 169,467 | 11/1875 | Newbrough . | |
| D. 226,439 | 3/1973 | Coker et al. | D34/5 K |
| D. 230,613 | 3/1974 | Coker et al. | D34/5 K |
| D. 242,732 | 12/1976 | Brentham | D34/5 K |
| 2,932,509 | 4/1960 | Zinkin | 272/58 |
| 3,003,765 | 10/1961 | Dove | 272/81 |
| 3,345,067 | 10/1967 | Smith | 272/82 |
| 3,471,146 | 10/1969 | Drakulich | 272/138 |
| 3,638,941 | 2/1972 | Kulkens | 272/83 R |
| 3,647,209 | 3/1972 | LaLanne | 272/58 |
| 3,662,602 | 5/1972 | Weiss | 73/381 R |
| 3,664,666 | 5/1972 | Lloyd | 272/83 K |
| 3,989,241 | 11/1976 | Ourgant | 272/136 |

FOREIGN PATENT DOCUMENTS

| | | | |
|---|---|---|---|
| 911939 | 4/1946 | France | 272/57 R |

OTHER PUBLICATIONS

The Athletic Journal, Sep. 1973, p. 18.
The Sporting Goods Dealer, Jul. 1968, p. 231.
Marcy Gymnasium Equipment Co., 1969 Dealer Catalog, p. 9.
The Athletic Journal, Nov. 1969, p. 80.

*Primary Examiner*—Steven A. Bratlie
*Assistant Examiner*—William R. Browne

[57] ABSTRACT

A multiple purpose exercise device has a stable ground-supported frame having a single structural rail extending vertically at the rear thereof. A series of vertically aligned holes in a flange attached to the rail receive fastening pins for separately adjustably securing an exercise bench and a lever arm. The lever arm may be secured in a rigid position or in an upwardly or downwardly biased position by an interchangeable series of rigid connecting bars and spring members to allow the user to perform various pushing and pulling exercises.

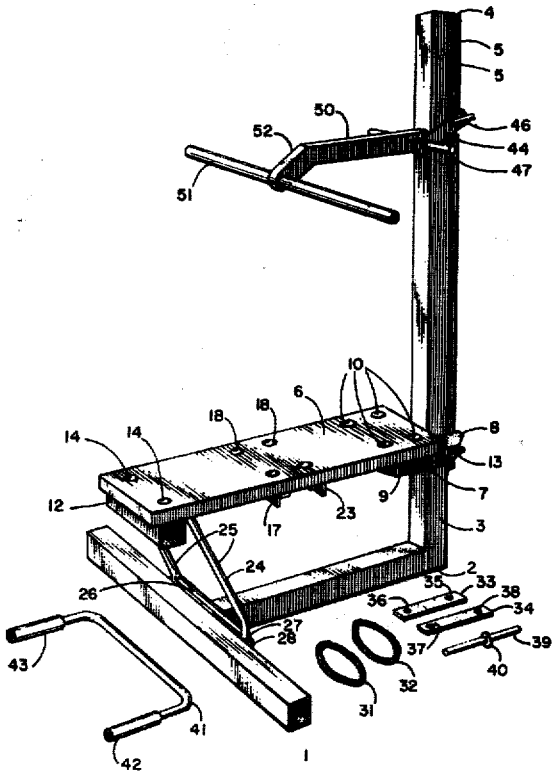

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6 and 8, having been finally determined to be unpatentable, are cancelled.

Claims 1 and 7 are determined to be patentable as amended:

Claims 2–5, dependent on amended claims, are determined to be patentable.

New claim 9 is added and determined to be patentable.

1. Multiple purpose exercise apparatus comprising:

a frame having forward and rearward positions comprising a ground-supported base and a stationary vertical support member extending upwardly from the rear of the base, *wherein the vertical support member includes a rail having a plurality of vertically aligned bores therein,* a bench, support means associated with said frame for maintaining the bench at a level above the base, a lever arm pivotally attached to said vertical support member and extending outwardly over said base, *the lever arm also comprising two fingers extending from the rearward portion thereof, each finger having a bore therein axially aligned with respect to the other, the apparatus also comprising a removable pin having circular-cross section for insertion consecutively through the bore in one finger, a bore in the rail, and the bore in the other finger, thereby pivotally connecting the lever arm to the rail so that the lever arm can move freely only in a vertical plane,* [fastening means for securing the lever arm to the support member comprising a plurality of vertically aligned bores in the support member, a transverse bore carried by the rearward portion of the lever arm, and pin means extending through both bores for removably pivotally attaching the lever arm to the vertical support member such that the lever arm can move freely only in a vertical plane,]

biasing means attachable to the lever arm at a position spaced from the connection of the lever arm on the vertical support member for selectively providing resistance to upward or downward motion of the lever arm in the vertical plane, and

*removable* attachment means *selectively* mountable in *a bore in the rail at a location either above or below the connection of the lever arm to the rail* [the vertically aligned bores] for selectively attaching the biasing means at various [position] *positions* on the vertical support member.

7. The apparatus of claim [6] *5* wherein the biasing means comprises a circular elastic cord.

*9. Multiple purpose exercise apparatus comprising:*

*a frame having forward and rearward positions comprising a ground-supported base and a stationary vertical support member extending upwardly from the rear of the base,*

*a bench, support means associated with said frame for maintaining the bench at a level above the base,*

*a lever arm pivotally attached to said vertical support member and extending outwardly over said base, fastening means for securing the lever arm to the support member comprising a plurality of vertically aligned bores in the support member, a transverse bore carried by the rearward portion of the lever arm, and pin means extending through both bores for removably pivotally attaching the lever arm to the vertical support member such that the lever arm can move freely only in a vertical plane,*

*resilient biasing means removably attachable to pin means on the lever arm at a position spaced from the connection of the lever arm on the vertical support member for selectively providing resistance to upward or downward motion of the lever arm in the vertical plane, and*

*attachment means mountable in the vertically aligned bores for selectively attaching the biasing means at various positions on the vertical support above or below the lever arm.*

* * * * *